US005724784A

United States Patent [19]

Menchetti

[11] Patent Number: 5,724,784

[45] Date of Patent: Mar. 10, 1998

[54] SHAFT WALL AND HORIZONTAL METAL STUD THEREFOR

[75] Inventor: Robert J. Menchetti, Buffalo, N.Y.

[73] Assignee: National Gypsum Company, Charlotte, N.C.

[21] Appl. No.: 385,673

[22] Filed: Feb. 8, 1995

Related U.S. Application Data

[63] Continuation-in-part of Ser. No. 93,026, Jul. 19, 1993, abandoned, which is a continuation-in-part of Ser. No. 858,797, Mar. 27, 1992, abandoned.

[51] Int. Cl.[6] ..... E04B 2/30; E04B 2/78

[52] U.S. Cl. ..... 52/483.1; 52/241; 52/275; 52/282.1; 52/781

[58] Field of Search ..... 52/479, 481.1, 52/483.1, 481.2, 489.1, 272, 275, 276, 278, 241, 242, 238.1, 780, 781, 282.1, 282.2, 282.3

[56] References Cited

U.S. PATENT DOCUMENTS

| | | | |
|---|---|---|---|
| Re. 24,658 | 6/1959 | Hollister . | |
| 585,111 | 6/1897 | Lehmann . | |
| 600,392 | 3/1898 | Whitenack | 52/281 |
| 619,968 | 2/1899 | Leonard . | |
| 1,361,831 | 12/1920 | Crew . | |
| 1,545,168 | 7/1925 | Schenck . | |
| 1,598,129 | 8/1926 | Gersman . | |
| 1,662,177 | 3/1928 | Williams . | |
| 1,816,933 | 8/1931 | Robinson et al. . | |
| 1,825,010 | 9/1931 | Murphy . | |
| 2,027,882 | 1/1936 | Ross . | |
| 2,042,290 | 5/1936 | Barrett | 52/481.1 |
| 2,044,637 | 6/1936 | Ross . | |
| 2,047,835 | 7/1936 | Prew . | |
| 2,049,278 | 7/1936 | Toussaint et al. . | |
| 2,065,493 | 12/1936 | Greulich . | |
| 2,076,472 | 4/1937 | London . | |
| 2,078,620 | 4/1937 | Venzie . | |
| 2,092,210 | 9/1937 | Greulich . | |
| 2,157,233 | 5/1939 | Geib, Jr. . | |
| 2,185,904 | 1/1940 | Stowe . | |
| 2,271,472 | 1/1942 | Balduf . | |
| 2,307,898 | 1/1943 | Olsen . | |
| 2,316,668 | 4/1943 | Bronner . | |

(List continued on next page.)

FOREIGN PATENT DOCUMENTS

| | | |
|---|---|---|
| 121075 | 3/1946 | Australia . |
| 202688 | 3/1993 | China . |
| 393 000 | 10/1990 | European Pat. Off. . |
| 1095143 | 3/1955 | France . |
| 1432551 | 2/1966 | France . |
| 51685 | 7/1889 | Germany . |
| 5-112992 | 5/1993 | Japan . |
| 7329104 | 11/1984 | Taiwan . |
| 493129 | 12/1936 | United Kingdom . |

OTHER PUBLICATIONS

Copy of paper titled "USG Cavity Shaft Wall, Area Separation Wall, Furring & Double Wall Components". Part of a publication of Unimast Inc. titled Steel Framing Components and Accessories For Drywall, Plaster and Load Bearing Construction. It contains the date 1992.

Copy of paper titled "Shaftwall/Stairwall Components". Part of a paper titled GYPROC Products and Systems and contains the date 1994.

*Primary Examiner*—Michael Safavi

*Attorney, Agent, or Firm*—Marshall, O'Toole, Gerstein, Murray & Borun

[57] ABSTRACT

A hollow shaft wall with horizontal studs having angled stud webs forming a channel with the stud inner flanges. Core boards are held by one edge in the angled channel and the other edge held by suitable means on an adjacent horizontal stud. Wallboards are spaced from the core boards and are secured to flanges of the studs. Supports are provided at the ends of the core boards and the studs for holding the wall in a vertical orientation.

31 Claims, 9 Drawing Sheets

U.S. PATENT DOCUMENTS 2,351,525 6/1944 Leary .
2,372,038 3/1945 Westveer .
2,495,862 1/1950 Osborn .
2,554,418 5/1951 Mortenson ..... 52/781
2,605,867 8/1952 Goodwin .
2,638,637 5/1953 Kump, Jr. .
2,663,181 12/1953 Collman .
2,752,013 6/1956 Cole .
2,976,971 3/1961 Lundberg .
3,013,644 12/1961 Smith et al. .
3,065,575 11/1962 Ray .
3,090,164 5/1963 Nelsson .
3,101,817 8/1963 Radek .
3,176,432 4/1965 Doolittle, Jr. .
3,225,503 12/1965 Rallis .
3,235,039 2/1966 O'Donnell .
3,242,627 3/1966 Fountain .
3,251,164 5/1966 Wright .
3,266,209 8/1966 Zibell ..... 52/489.1
3,271,920 9/1966 Downing, Jr. .
3,274,739 9/1966 Gregoire .
3,287,041 11/1966 Cohen .
3,294,353 12/1966 Rowe .
3,312,032 4/1967 Ames .
3,349,535 10/1967 Balinski .
3,362,056 1/1968 Preller et al. .
3,381,439 5/1968 Thulin, Jr. .
3,397,500 8/1968 Watson, Jr. .
3,418,776 12/1968 Manderbach et al. .
3,428,326 2/1969 Clapsaddle .
3,477,184 11/1969 Johnson et al. .
3,485,001 12/1969 Miller .
3,495,417 2/1970 Ratliff, Jr. .
3,508,364 4/1970 Thompson ..... 52/479
3,517,474 6/1970 Lanternier .
3,603,054 9/1971 Didry .
3,651,610 3/1972 Donahue .
3,702,044 11/1972 Balinski .
3,705,002 12/1972 Varlonga .
3,740,912 6/1973 Sauer et al. .
3,765,138 10/1973 Bentle .
3,839,839 10/1974 Tillisch et al. .
3,845,594 11/1974 Butts et al. .
3,845,601 11/1974 Kostecky .
3,866,376 2/1975 Nelsson .
3,881,293 5/1975 Conville .
3,921,346 11/1975 Sauer et al. ..... 52/481.1
3,940,899 3/1976 Balinski .
3,950,900 4/1976 Simpson .
3,974,608 8/1976 Grearson .
4,002,261 1/1977 Litchfield .
4,011,704 3/1977 O'Konski .
4,024,691 5/1977 Hansen et al. .
4,047,347 9/1977 Scheid .
4,047,354 9/1977 Sutherland .
4,047,355 9/1977 Knorr ..... 52/481.1
4,074,486 2/1978 Grearson .
4,109,440 8/1978 Bill .
4,125,984 11/1978 Jonas .
4,129,970 12/1978 Whitney .
4,147,379 4/1979 Winslow .
4,187,653 2/1980 Kliewer, Jr. .
4,201,020 5/1980 Saunders .
4,240,234 12/1980 Eisinger et al. .
4,251,973 2/1981 Paik .
4,353,192 10/1982 Pearson et al. .
4,364,212 12/1982 Pearson et al. .
4,435,936 3/1984 Rutkowski ..... 52/481.1
4,443,991 4/1984 Mieyal .
4,587,783 5/1986 McCoy et al. .
4,597,278 7/1986 Hamada et al. .
4,640,076 2/1987 Milgliore .
4,852,325 8/1989 Dunn et al. .
4,866,899 9/1989 Houser .
4,893,446 1/1990 Gudmundsson et al. ..... 52/241
4,897,976 2/1990 Williams et al. .
4,905,428 3/1990 Sykes .
4,909,006 3/1990 Hickman et al. .
4,914,880 4/1990 Albertini .
4,918,879 4/1990 Bodurow et al. .
4,969,304 11/1990 Helderman .
4,982,540 1/1991 Thompson .
5,065,559 11/1991 Zegel et al. .
5,090,174 2/1992 Fragale .
5,092,100 3/1992 Lambert et al. .
5,094,052 3/1992 Gudmundsson et al. .
5,129,628 7/1992 Vesper .
5,263,295 11/1993 Laird et al. .

Fig. 20
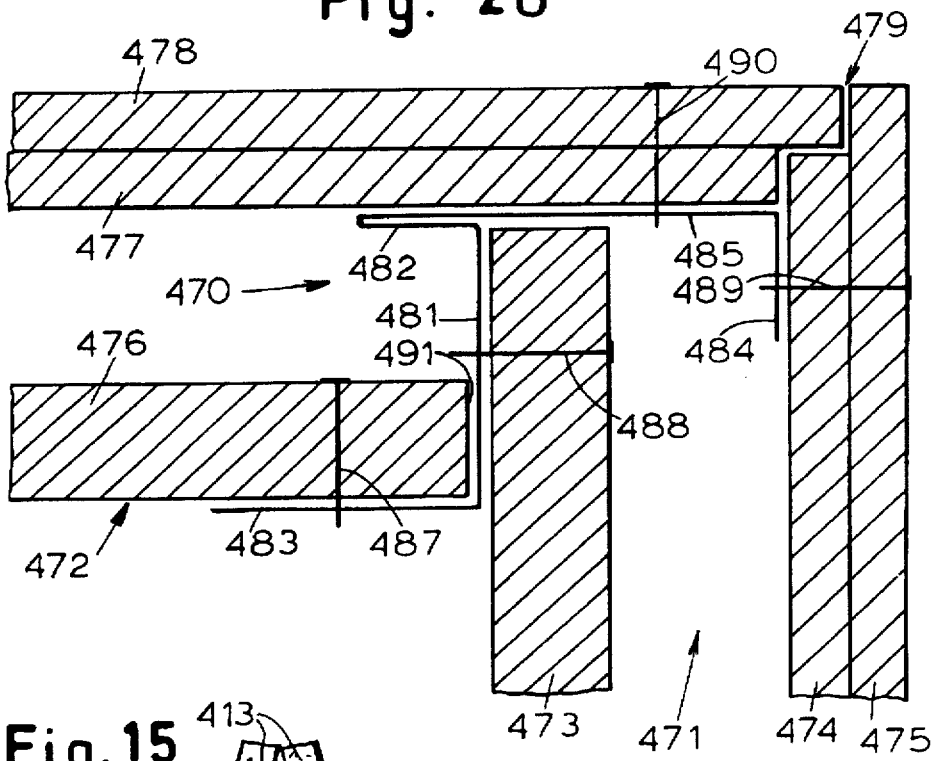
Fig. 15
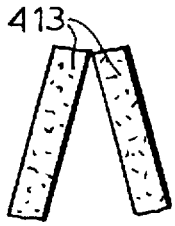
Fig. 14
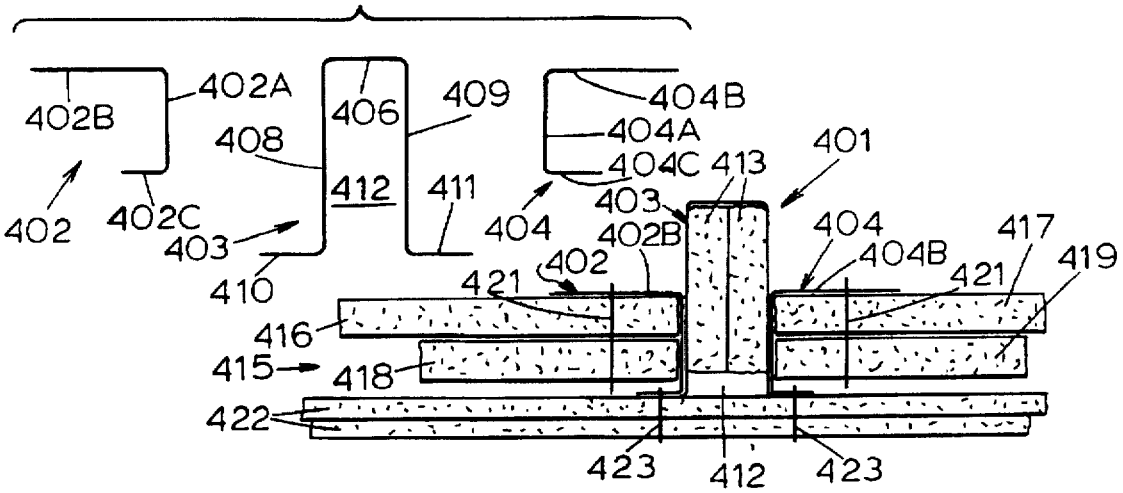
Fig. 13

SHAFT WALL AND HORIZONTAL METAL STUD THEREFOR

RELATED APPLICATIONS

This application is a continuation-in-part of my application Ser. No. 08/093,026, filed Jul. 19, 1993, now abandoned, which is a continuation-in-part of application Ser. No. 07/858,797, filed Mar. 27, 1992, now abandoned.

FIELD AND BACKGROUND OF THE INVENTION

This invention relates to sheet metal studs for supporting gypsum wallboard and to improved fire-resistant hollow shaft walls.

Several patents have disclosed hollow shaft walls employing metal studs and gypsum wallboards; for example, U.S. Pat. Nos. 3,740,912 and 4,353,192. These prior patents all employ metal studs between adjacent gypsum core boards, which metal studs are vertical studs. These prior patents also have one-inch-thick core boards which have square edges abutting the webs of the vertical studs. The core boards commonly employed in these systems sometimes include slightly bevelled edges, strictly for ease of insertion into the channels formed between flanges and tabs.

These prior structures have enjoyed considerable commercial success; however, a shaft wall which can be more easily installed at lower cost and have improved performance is clearly desirable. These prior structures also required the studs to have greater flange-to-flange dimensions as walls were made progressively higher, resulting in increased steel usage and an increase in cost and labor.

SUMMARY OF THE INVENTION

In the present invention, novel sheet metal studs are placed horizontally between adjacent, horizontally extending gypsum core boards, typically in the four walls surrounding an elevator shaft and stairwells, and in area separation walls and the like. The metal studs include, essentially, an inner flange, an outer flange and an adjoining web connecting the flanges, with a core board abutting each side of the web. At least a narrow portion of the web which is closely adjacent the inner flange is in a plane which forms an acute angle with the inner flange, creating a channel-like means for holding an edge of one of the two core boards against the inner flange. The web also includes means for holding an edge of the second core board against the inner flange, on the opposite side of the web.

As a specific example, two-foot wide and up to ten-foot long, one-inch-thick gypsum core boards are disposed, with their widths extending vertically and their lengths extending horizontally, between the horizontally extending studs, said boards preferably having bevelled lateral edges which abut the acutely angled webs of the studs.

The typical long side of a shaft enclosure is ten-feet long and consists essentially of alternating ten-foot long, horizontally extending core boards and ten-foot long, horizontally extending metal studs. The ends of the metal studs and the core boards are disposed within a channel in a suitable vertically extending corner stud or the like. Two layers of standard or special fire-retardant, typically 4-foot wide gypsum wallboard (referred to herein as wide wallboard) are screw attached to the outer flanges of the metal studs.

The corner stud has two outwardly opening channels directed at right angles, and the core boards and horizontal studs of two perpendicular walls extend into the two respective channels.

The corner stud can be replaced by corner clips as described in my application Ser. No. 08/022,590, filed Feb. 25, 1993, which is incorporated herein by reference.

In an extra-long wall, an improved intermediate vertical post may be provided.

It is an object of the present invention to provide a novel horizontal stud and a novel and improved wall construction utilizing such horizontal studs.

It is a further object of the invention to provide an improved, more economical shaft wall, suitable for erection from one side.

It is a still further object of the invention to provide a method of erecting walls which result in improved walls at a reduced cost.

It is a still further object of the invention to provide a method of erecting shaft walls which inherently includes the initial construction of a relatively low safety wall around the shaft opening that also provides ready access to the shaft for the installation of cants and the like.

It is a still further object of the invention to provide a shaft wall which is not substantially weakened by omission or removal of a narrow top portion for the installation of elevator rail supports/brackets.

It is still a further object of the invention to provide a shaft wall system that requires the stocking of fewer components for typical shaft wall installations.

BRIEF DESCRIPTION OF THE DRAWINGS

These and other objects and advantages of the invention will be more readily apparent when considered in relation to the preferred embodiments as set forth in the specification and shown in the drawings in which:

FIG. 13 is a sectional view of an improved intermediate vertical post in accordance with the invention.

FIGS. 14 and 15 are exploded views of parts of the vertical post shown in FIG. 13.

FIG. 20 is a view similar to FIG. 2 but showing a preferred construction of the corner post.

DESCRIPTION OF THE PREFERRED EMBODIMENTS

Figure 1:
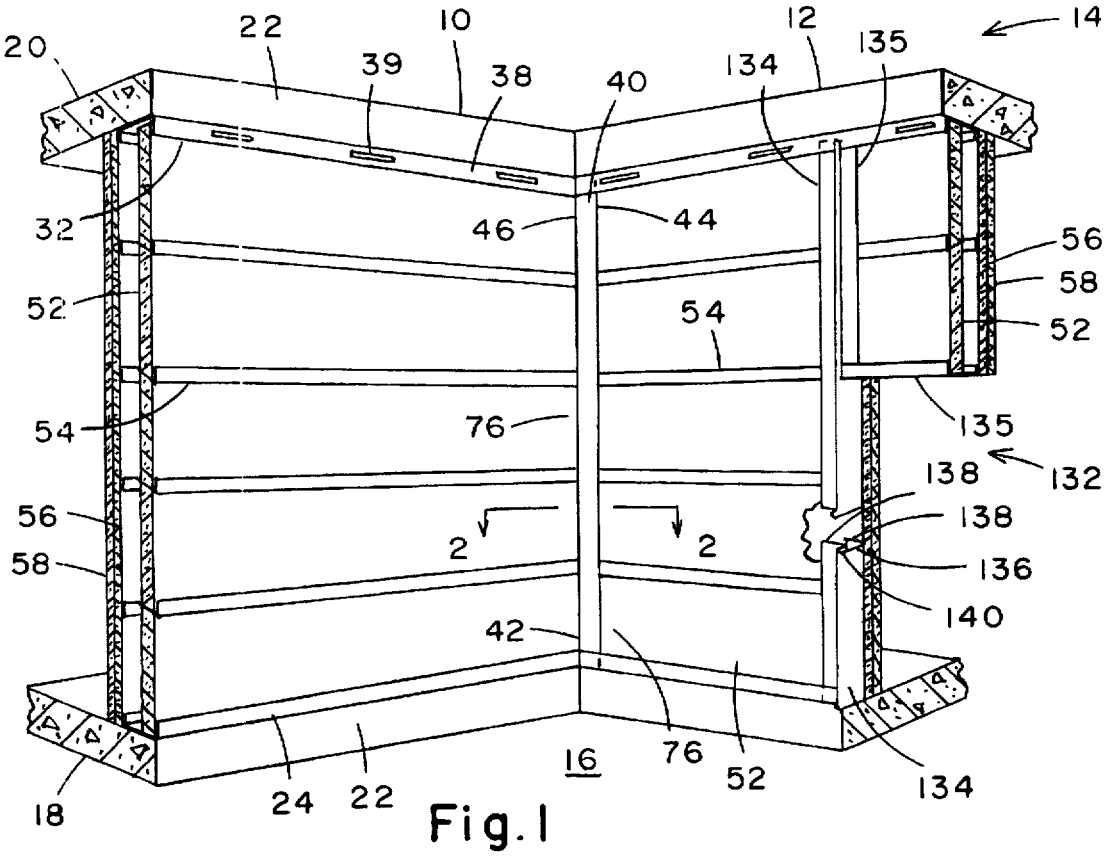
FIG. 1 is a perspective view of a portion of two perpendicular walls of an elevator shaft enclosure, constructed in accordance with the invention.

Referring to FIG. 1, there is shown part of a side wall 10 and part of a front wall 12 of a hollow shaft wall structure 14 surrounding an elevator shaft 16. Elevator shaft 16 extends vertically through a plurality of floor-ceiling platforms, including the lower platform 18 and the upper platform 20 of FIG. 1. The shaft wall structure 14 extends vertically from the lower platform 18 to the upper platform 20 along the edges 22 of these floor-ceiling platforms which surround and form the elevator shaft 16.

Side wall 10 consists of a standard upwardly opening, channel-shaped floor track 24 (FIG. 3), having a horizontal web 26 and two vertical flanges 28, 30, and a downwardly opening, channel shaped, ceiling track 32, having a horizontal web 34 and two vertical flanges 36, 38. Floor track 24 is mechanically affixed to the top of lower platform 18 and ceiling track 32 is mechanically affixed to the bottom of upper platform 20, each adjacent the edges 22 of these floor-ceiling platforms. Ceiling track 32 preferably has a plurality of spaced-apart vent openings 39 along the top edge of flange 38, to improve the wall fire-resistance. Ceiling track 32 can also be used as a floor track.

Figure 2:
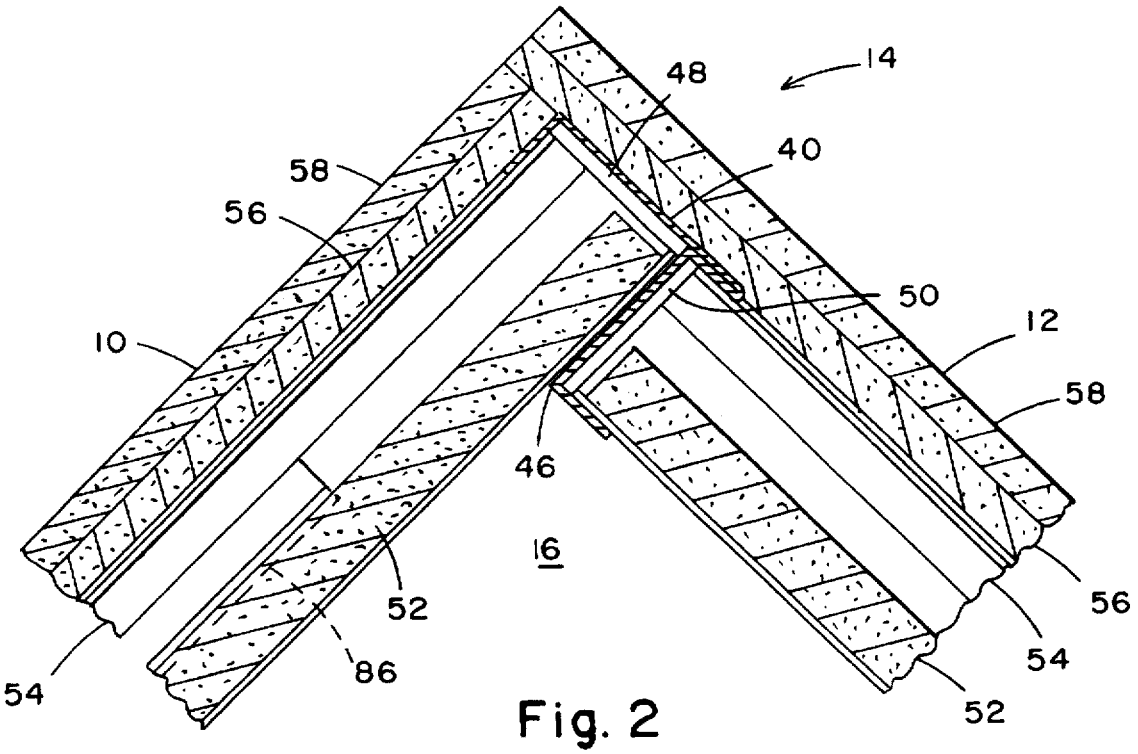
FIG. 2 is a cross-sectional plan view of the wall corner, taken on line 2—2 of FIG. 1.

At the corner of side wall 10 and front wall 12, as seen in FIGS. 1 and 2, a vertical corner post 40 is mounted with a bottom end 42 disposed in a floor track 24 and a top end 44 disposed in a ceiling track 32, where the two floor tracks 24 and the two ceiling tracks 32 meet to form a 90° corner 46 between side wall 10 and front wall 12. The corner post 40, which could be made by affixing two channels together back-to-side, is preferably a single, elongate, roll-formed sheet of metal having two outwardly opening channels 48, 50 formed of a single piece of 0.020-inch-thick steel, with the two channels 48 and 50 opening outwardly in directions at a 90° angle to one another and being directed toward, respectively, the side wall 10 and the front wall 12. FIG. 20 illustrates a preferred corner post design to be described in greater detail hereinafter.

As seen in FIGS. 1 and 2, the vertical corner post 40, comprises a formed single-piece sheet metal member including two channels 48, 50 each of which consists solely of a bottom wall and parallel, spaced, inner and outer side walls extending perpendicularly from the bottom wall. The bottom wall of a first one of said channels (opening downwardly and to the right in FIG. 2) is also the inner side wall of a second one of said channels (opening downwardly and to the left in FIG. 2). Also, the bottom wall of the second one of said channels will be seen to be coplanar with the outer side wall of the first one of said channels.

A modified wall, in which corner clips replace corner post 40, is disclosed in Ser. No. 08/022,590, filed Feb. 25, 1993.

Figure 3:
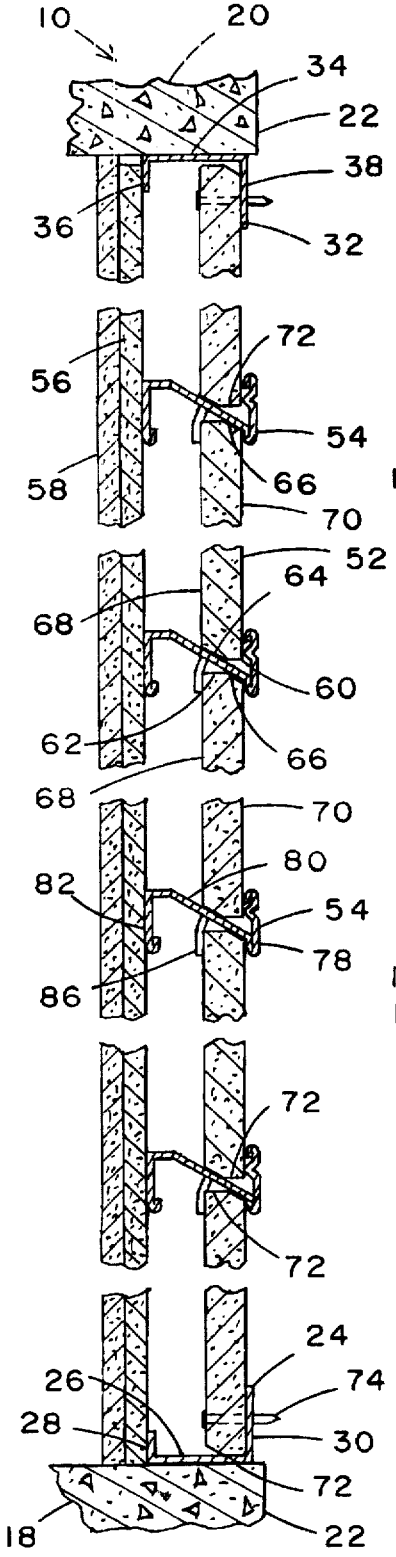
FIG. 3 is a cross-sectional end view of the left wall of FIG. 1.

Considering the side wall 10, FIG. 3 shows the arrangement of core boards 52, horizontal studs 54, and outwardly disposed gypsum wide wallboards 56, 58, which combine to form the side wall 10.

Figure 6:
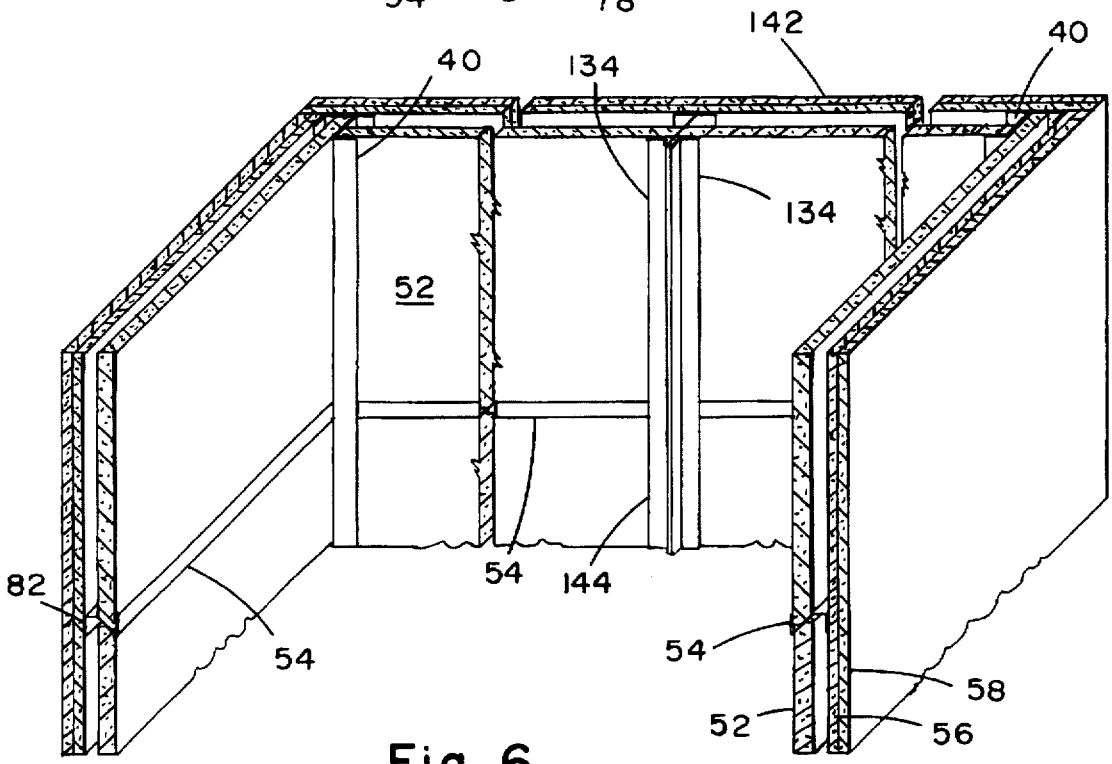
FIG. 6 is an isometric view of an extra-long wall embodying the invention.

Typically the core boards 52 are paper-covered gypsum boards which are, in cross section, 2 feet by 1 inch, and will normally have a length equal to the horizontal extent of the wall 10 (except in the instance of an extra long wall in which case a vertical post 144, shown in FIG. 6, is provided). Of particular importance are the bevelled edges 60, 62 along the two long edges of each core board 52. Alternatively, non-bevelled board can be used. Preferably, the bevelled edges 60, 62 on each core board 52 have a bevel 64, 66 which is in a plane forming an angle of 120° with one of the core board faces and 60° with the opposite core board face, and preferably, when installed as shown in FIG. 3, the bevelled edges 60, 62 are parallel, one with the other, whereby the bevel 64 on edge 60 is at an angle of 120° with core board face 68 and an angle of 60° with core board face 70, whereas bevel 66 on edge 62 is at an angle of 120° with core board face 70 and an angle of 60° with core board face 68.

Preferably, the bevelled edges 60, 62 have a flat portion 72, of a width of about ⅜ inch, however, this could be varied considerably.

After the floor track and the ceiling track are in place, the first core board 52 to be installed in constructing the wall 10 has a flat portion 72 resting on web 26 of floor track 24 and face 70 is held against flange 30 by a plurality of screws 74. The two ends 76 (one shown in FIG. 1) of core board 52 extend into corner posts 40 (one shown) but are not affixed thereto. On top of the first core board 52 to be installed is the first horizontal stud 54 to be installed, and progressively, in constructing wall 10, additional core boards 52 and horizontal studs 54 alternately are put into place, each extending at each end thereof into the channel 48 of corner posts 40 (one shown) but, preferably, neither core boards 52 nor studs 54 are affixed thereto.

Figure 4:
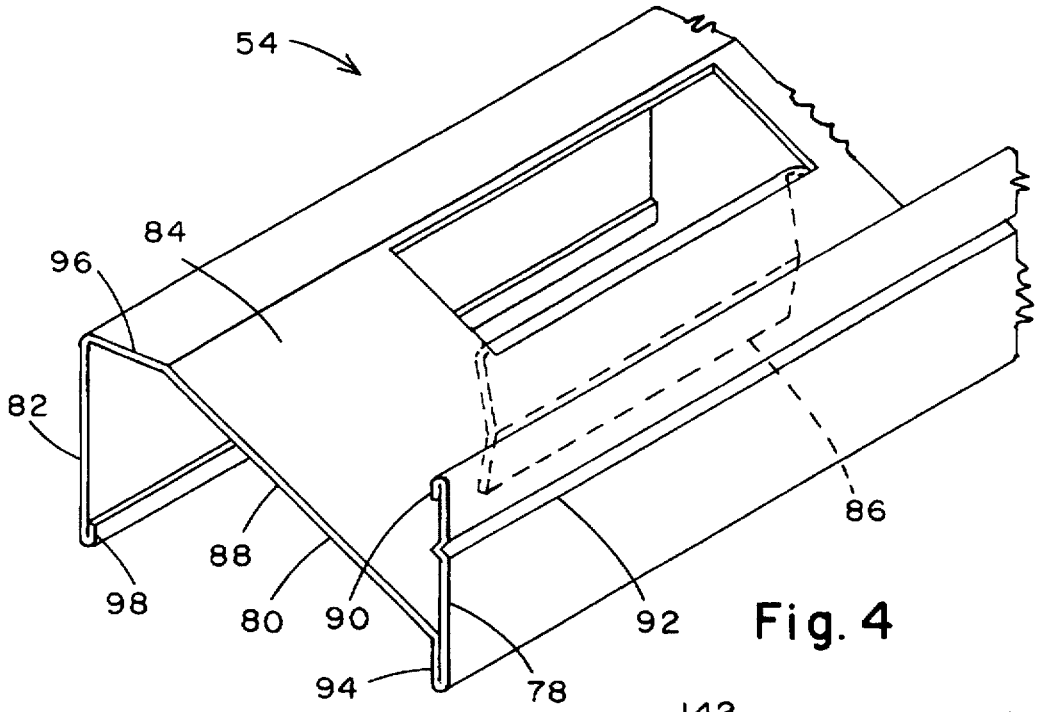
FIG. 4 is an isometric view of a horizontal stud of the walls of FIG. 1.

The horizontal studs 54, shown in FIGS. 3 and 4, are each a single, elongate, roll-formed sheet of metal, preferably 0.020-inch-thick steel, and include, essentially a Z-shaped cross section which includes an inner flange 78, a web 80 extending outwardly from inner flange 78 with an inwardly facing surface 84 which forms an angle of 60° with inner flange 78, an outer flange 82 which is parallel to and preferably about 2-½ inches from inner flange 78 and a means 86 for holding a core board edge 62 against outwardly facing surface 88 of web 80. The stud 54 will be seen to form two opposed pockets for receiving the edges of two adjacent core boards 52.

In the form as shown in FIG. 4, the means 86, for holding core board edge 62 against the outwardly facing surface 88 of web 80, is a plurality of tabs 86 formed of about 1-inch high by about 3-inch long sections of metal cut and bent out of web 80, located about every 12 inches. The inner flange 78 has a narrow, outwardly-turned hem 90. Inner flange 78 also has an outwardly depressed, elongate rib 92 with depth equal to the outward extent of hem 90. Rib 92 prevents twisting of the stud 54 when a builder rests a core board on the top of outer flange 82 during construction. Inner flange 78 has a short, downwardly extending, elongate lip 94 formed by a reverse bend of the sheet metal and web 80 is adjoined to inner flange 78 at the top of lip 94. The inner flange 78 can be strengthened to some degree by forming the flange with the double thickness extending upwardly and the single thickness extending downwardly, with a hem at the bottom, as illustrated in FIGS. 9–12.

An elongate, outermost portion 96 of web 80 is perpendicular to the outer flange 82, and outer flange 82 has a narrow, inwardly turned hem 98.

In the embodiment shown in FIG. 3, all the horizontal studs 54 are disposed with the inner flange 78 extending primarily upwardly from web 80 and the outer flange 82 and tabs 86 extending downwardly from web 80. It will be readily understood how gravity assists in the installation of the upper core board engaged in each stud 54. Two layers of gypsum wide wallboard 56, 58, preferably 4-foot wide and ½-inch or ⅝-inch thick, are screw attached to the outer flange 82 of each horizontal stud 54 and to corner posts 40.

In alternative embodiments, not shown, the horizontal studs 54 could be reversed with inner flanges 78 extending downwardly and the outer flanges 82 and tabs 86 extending upwardly, necessitating a reversal of the faces of the core boards 52. In this embodiment, tabs could interfere with the installation of the upper board, making construction a little more difficult. In a still further alternative embodiment, alternate horizontal studs 54 could be reversed, necessitating the use of core boards with bevels on the same side on each core board and with core board faces alternating on adjacent core boards. This alternating embodiment will be clearly understood from the alternative embodiment of FIG. 5.

Figure 5:
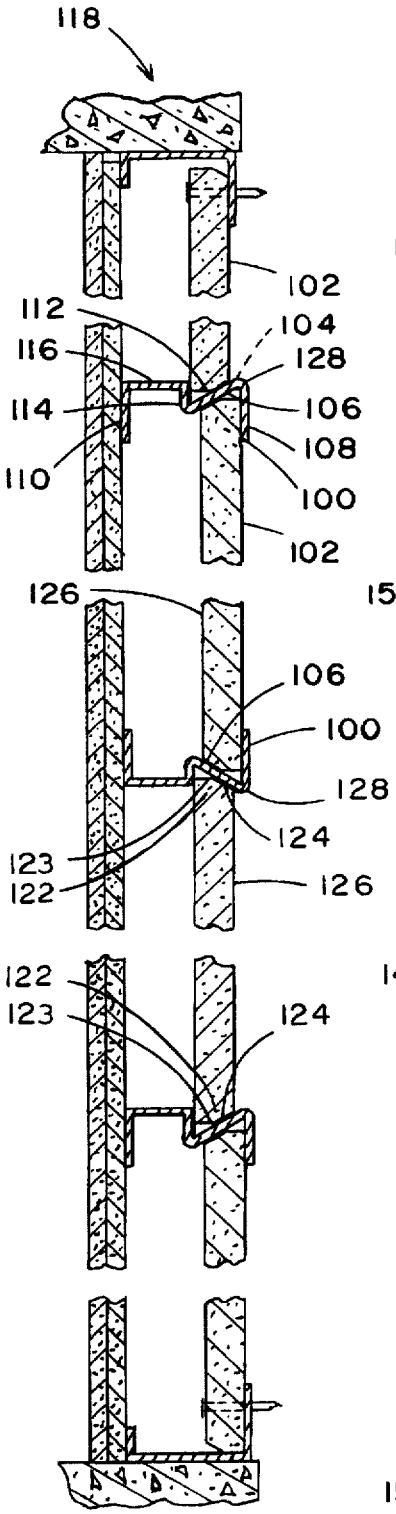
FIG. 5 is a cross-sectional end view of a modified wall embodying the invention.

In FIG. 5, a different embodiment of the invention, employing modified horizontal studs 100, is shown, with the horizontal studs 100 arranged to show an alternating stud arrangement. The embodiment of FIG. 5 also has non-aligned core boards 102, which permit the inclusion of vent holes 104 in the webs 106.

The elongate horizontal studs 100 have inner flanges 108 and outer flanges 110 which are parallel and extend in the same direction from the web 106. The web 106 includes three elongate elements, a diagonal section 112 extending outwardly at 60° from one edge of inner flange 108, a mid-wall 114 extending from the opposite edge of diagonal section 112 in the opposite direction as and parallel to the inner flange 108, and an outermost portion 116 which is perpendicular to the outer flange 110 and to mid-wall 114.

In order to improve the fire-resistant character of the wall 118, the mid-wall 114 is spaced outwardly of the inner flange 108, a distance greater than the thickness of the core boards 102, preferably a 1-¼-inch spacing with 1-inch-thick core board 102. Core board 102 having a flat portion 123 and a bevelled portion 124, has edges 122, 122 with the bevel 124 of each edge adjacent the same face 126. The core boards 102 and the studs 100 are both erected in an alternating manner, with adjacent core boards 102 having faces 126 facing oppositely and adjacent horizontal studs having upper and lower sides reversed. Consequently, every other core board 102 is disposed outwardly ¼ inch, leaving an inner ¼-inch strip 128 of web 106 exposed. A plurality of vent openings 104 are formed at spaced locations along this inner ¼-inch strip 128. When a wall 118 is exposed to a fire, air is able to move through vent openings 104, cooling the wall 118.

Referring now to front wall 12 of FIG. 1, an elevator doorway 132 is shown, formed by two vertical roll-formed, sheet metal elongate door-frame posts 134 (one vertical post not shown), (similar door frame posts are shown in FIG. 6). As shown in a broken-away portion in FIG. 1, the door frame posts 134 include a web 136, two perpendicular flanges 138 and an inwardly protruding lip 140. A short section of regular formed sheet metal elongate channel 135 is affixed back-to-back with the portion of vertical door frame post 134 extending from the top of doorway 132 to the ceiling track 32, and another section of channel 135 extends across the top of doorway 132.

Front wall 12 has short sections of core board 52 alternating with short sections of horizontal stud 54 along the side of doorway 132, with boards 52 and studs 54 extending into the channel 50 of corner post 40 and into the door frame post 134. Other short sections of horizontal studs 54 and core boards 52 extend horizontally over doorway 132 and into the short sections of channel 135. Two layers of gypsum wide wallboard 56, 58 are screw attached to the outer flanges of horizontal studs 54 and to posts 40 and 134.

Referring now to FIG. 6, an extra-long wall 142 is shown, constructed in accordance with the invention. The horizontal studs 54 preferably will not be more than 10-feet long for most elevator shaft walls, particularly with only 2-½-inch-wide studs. For walls having a length greater than 10 feet, an intermediate vertical post 144 is positioned at spacings of 10 feet or less. A suitable intermediate vertical post 144 is shown formed of two door frame posts 134, back-to-back, preferably mechanically affixed together, however other configurations can also be used, including a preferred post shown in FIGS. 13 to 15. Core boards 52 and horizontal studs 54 are shown extending from within corner posts 40 to within intermediate vertical post 144. Wide wallboards 56, 58 are affixed to the outer flanges 82 of the horizontal studs 54.

FIGS. 9 through 12 show four additional modified studs in accordance with this invention.

Figure 9:
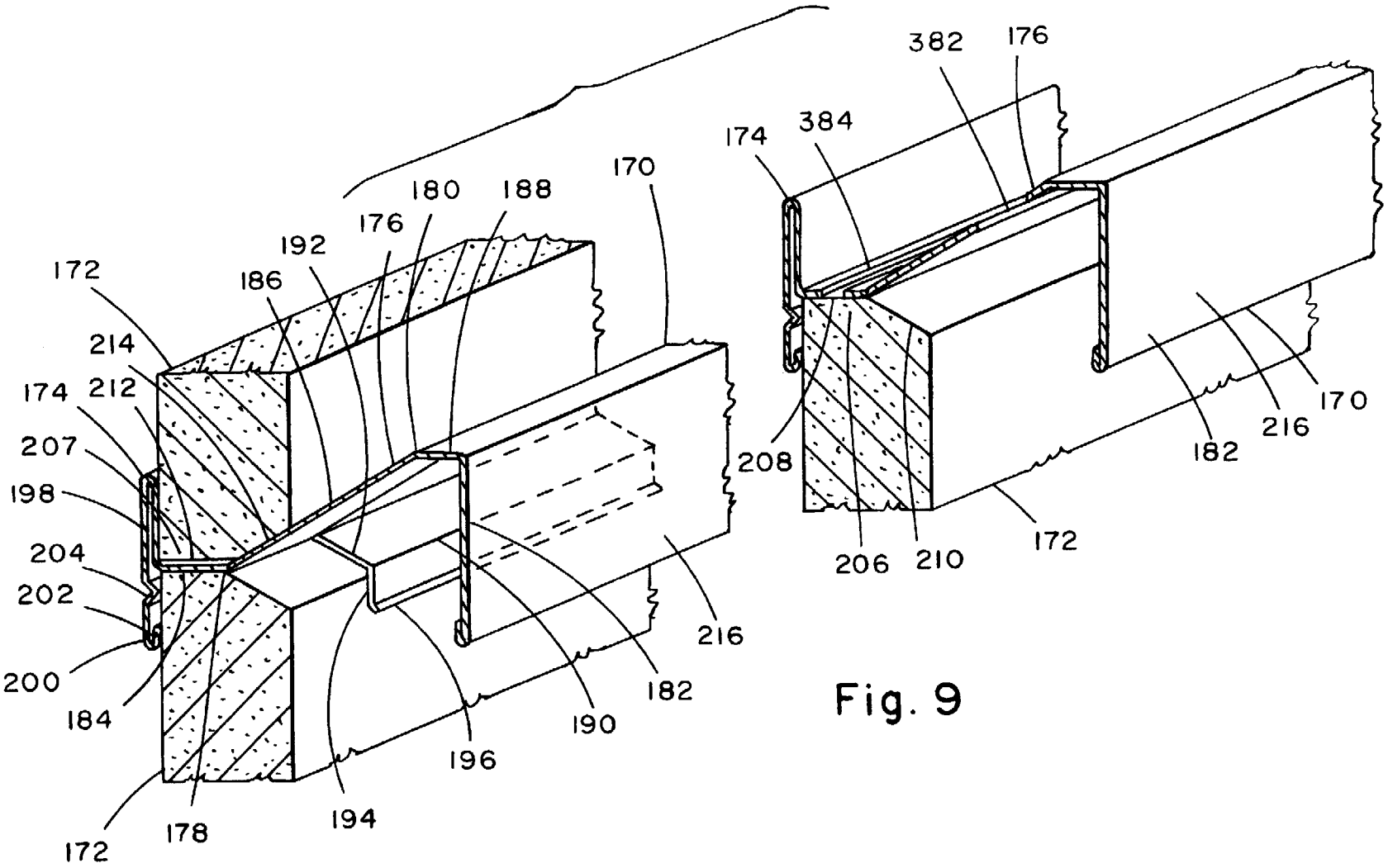
FIGS. 9–12 are isometric views of four modified horizontal studs with core boards in place, all in accordance with the invention.

FIG. 9 shows horizontal stud 170 with two core boards 172, in a manner similar to the structures of FIGS. 1, 2 and 6. Horizontal studs 170 and core boards 172 are assembled into vertical corner posts 40, intermediate posts 144 and door frame posts 134 similar to core boards 102.

Horizontal stud 170 is an elongate, roll-formed sheet of metal with a cross section which includes an inner flange 174, a web 176 extending perpendicularly outwardly from the middle of inner flange 174 for about 9/16 inch to a 30° upward bend 178, then extends upwardly and outwardly to a 30° downward bend 180 and then extends outwardly to downwardly extending outer flange 182. Bends 178 and 180 thus divide web 176 into an inner flat portion 184, a central diagonal portion 186 and an outer flat portion 188. In the several disclosed embodiments of this invention it is important that a portion of the web be at an acute angle to the inner flange at a portion which is spaced outwardly from the inner flange. This angled portion may extend inwardly and be adjoined to the inner flange or the angled portion may be adjoined to the inner flange by a narrow portion perpendicular to the inner flange.

Horizontal stud 170 also includes a plurality of downwardly extending tabs 190 formed of 1-inch by 3-inch sections of metal cut and bent out of central diagonal portion 186. Tabs 190 are adjoined to central diagonal portion 186 adjacent to bend 178, and include a downwardly and outwardly extending angled portion 192 and a downwardly extending portion 194 terminating in a downwardly and outwardly angled lip 196 for ease of insertion of a core board 172.

Inner flange 174 includes an upper double-thickness portion 198 and a lower single-thickness portion 200 which includes a lower hem 202 and a midway rib 204. Hem 202 and rib 204 both extend outwardly from the balance of lower portion 200.

Horizontal stud 170 is mounted atop an upper edge portion 206 of one of the two core boards 172 in FIG. 9, and a lower edge portion 207 of the other core board 172 is disposed atop stud 170.

The upper edge portion 206 of the one core board 172 is held firmly between tabs 190 and the hem 202 and rib 204 of single-thickness portion 200 of inner flange 174. Upper edge portion 206 has a flat top portion 208 and a bevelled portion 210. Flat portion 208 abuts inner flat portion 184 of web 176 and bevelled portion 210 is parallel to and closely spaced from angled portion 192 of tab 190.

The lower edge portion 207 of the other core board 172 has a flat bottom portion 212, similar to flat top portion 208, and a bevelled portion 214, similar to bevelled portion 210. Bevelled portion 214 rests on central diagonal portion 186 of web 176 and flat bottom portion 212 is parallel to and closely spaced from inner flat portion 184 of web 176.

The very heavy, normally about ten-foot long core boards 172 are relatively easily inserted onto each previously mounted horizontal stud 170 by merely sliding the bevelled portion 214 down the central diagonal portion 186 until the lower edge 207 abuts the double-thick portion 198 of inner flange 174. Lower edge portion 207 is held firmly between inner flange 174 and diagonal portion 186 by the weight of the core board 172, plus the weight of all core boards 172 and horizontal studs 170 which are thereabove a part of the wall.

The horizontal studs 170 fit tightly onto the upper edge 206 of core boards 172, but being much lighter and easier to manipulate than the core boards 172, very little problem is involved in this step. Gypsum wide wallboard (not shown) is screw attached against the outer surfaces 216 of the outer flanges 182 and to posts 40, 134 and 144.

Figure 10:
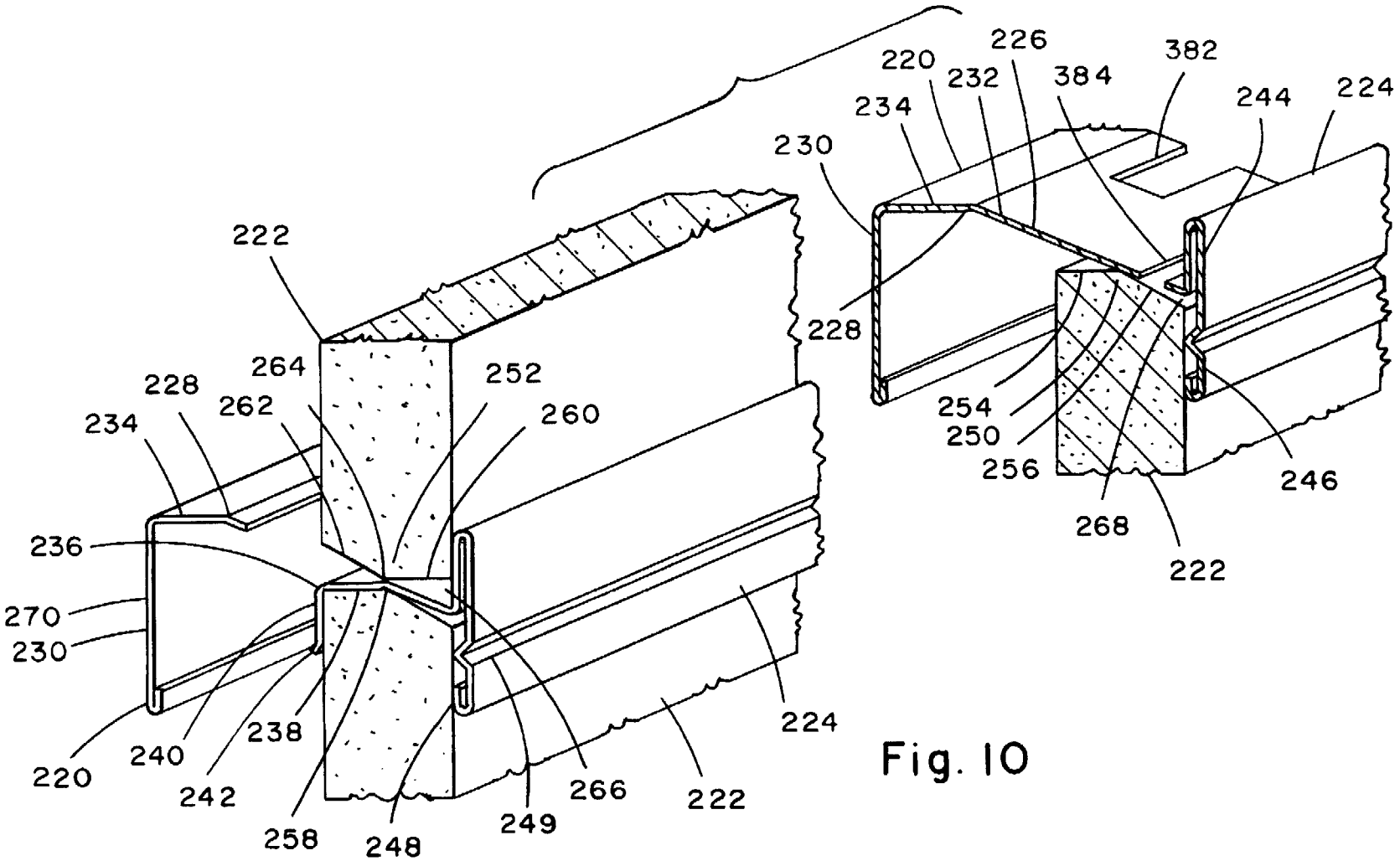

FIG. 10 shows horizontal stud 220 with two core boards 222, similar to core boards 52. Horizontal studs 220 and core boards 222 are assembled into vertical corner posts 40, intermediate posts 144 and door frame channels 134 in a manner similar to the structures of FIGS. 1, 2 and 6.

Horizontal stud 220 is an elongate, roll-formed sheet of metal with a cross section which includes an inner flange 224, a web 226 extending outwardly and upwardly from the middle of inner flange 224 to a downward bend 228 and then extends outwardly to downwardly extending outer flange 230. Bend 228 thus divides web 226 into an inner diagonal portion 232 and an outer flat portion 234.

Horizontal stud 220 also includes a plurality of downwardly extending tabs 236 formed of 1-inch by 3-inch sections of metal cut and bent out of inner diagonal portion 232. Tabs 236 are adjoined to the inner diagonal portion 232 of web 226 at about the middle of diagonal portion 232 and includes a downwardly and outwardly extending portion 238, a downwardly extending portion 240, and a downwardly and outwardly angled lip 242 for ease of insertion of core board 222.

Inner flange 224 includes an upper double-thickness portion 244 and a lower single-thickness portion 246 which includes a lower hem 248 and a midway rib 249, both extending outwardly.

Horizontal stud 220 is mounted atop an upper edge portion 250 of one of the two core boards 222 in FIG. 10, and a lower edge portion 252 of the other core board 222 is disposed atop stud 220.

The upper edge portion 250 of the one core board 222 is held firmly between tabs 236 and the hem 248 and rib 249 of single-thickness portion 246 of inner flange 224. Upper edge portion 250 has a flat top portion 254 and a bevelled portion 256 with an elongate corner 258 therebetween of about 150°.

The lower edge portion 252 of the other core board 222 has a flat bottom portion 260, similar to flat top portion 254 with the exception that it is on the opposite side of the core board 222, a bevelled portion 262, similar to bevelled portion 256 but also on the opposite side of core board 222, and an elongate corner 264 therebetween of about 150°.

The inner diagonal portion 232 of web 226 forms an angle 266 of 70° with upper double-thickness portion 244 of inner flange 224. Since the corners 258 and 264 are both about 150°, the bevelled portions 256 and 262 extend at an angle 268 of about 60° relative to the upper double-thickness portion 244. Consequently, the upper edge portion 250 and the lower edge portion 252 of the core boards 222 both abut the web diagonal portion 232 at the corners 258 and 264.

The core boards 222 are easily inserted onto each previously mounted horizontal stud 220, and the lower edge portion 252 is held firmly between inner flange 224 and web diagonal portion 232 by the weight of the core board 222, plus the weight of all core boards 222 and horizontal studs 220 which are thereabove a part of the wall. Horizontal studs 220, being much lighter than the core boards 222, can be reasonably easily forced down onto the upper edge portions 250 of the core boards 222. Gypsum wide wallboard (not shown) is screw attached against the outer surfaces 270 of the outer flanges 230 and to posts 40, 134 and 144.

Figure 11:
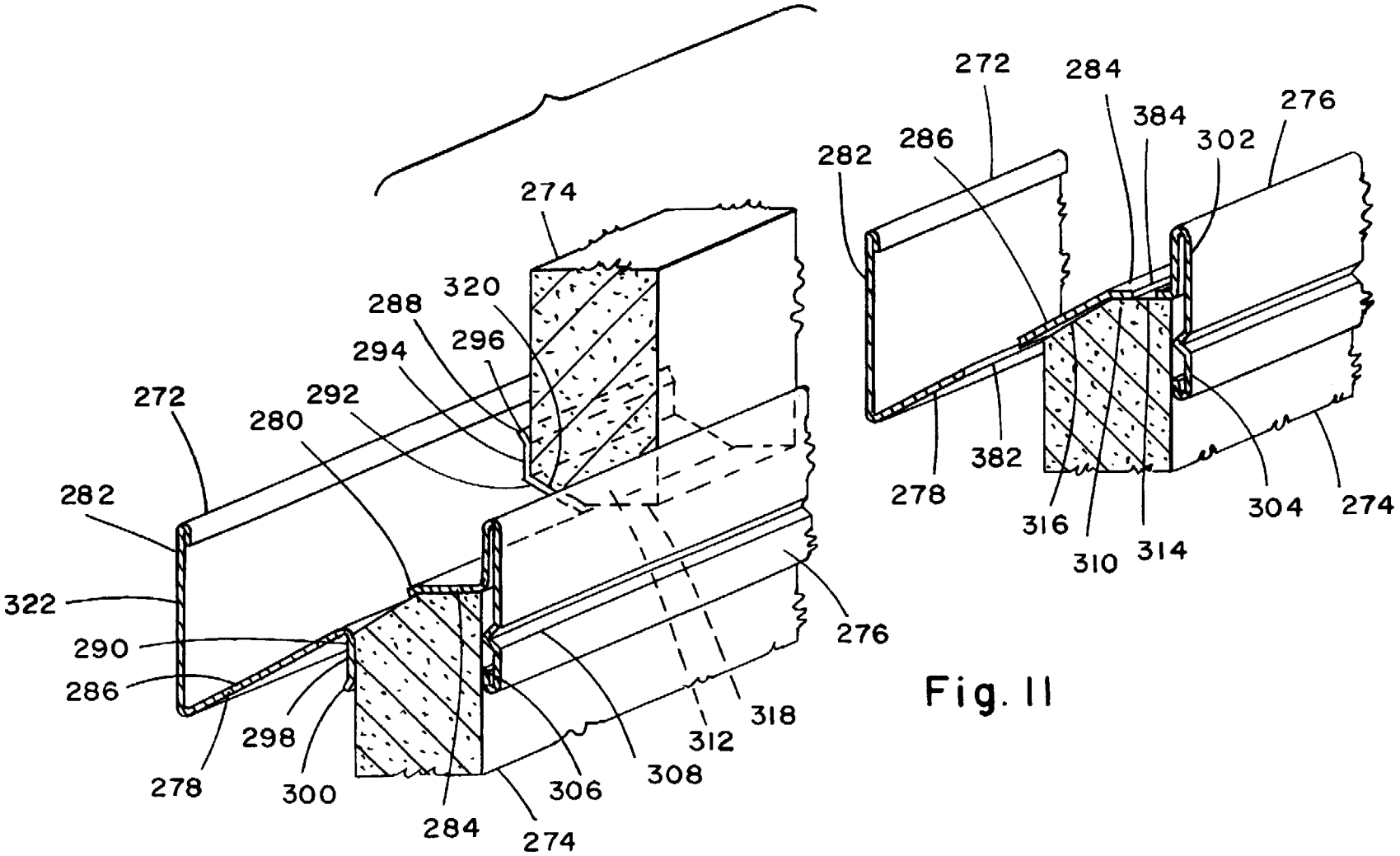

FIG. 11 shows horizontal stud 272 with two core boards 274, similar to core boards 102. Horizontal studs 272 and core boards 274 are assembled into vertical corner posts 40, intermediate posts 144 and door frame channels 134 in a manner similar to the structures of FIGS. 1, 2 and 6. Horizontal stud 272 is an elongate roll-formed sheet of metal with a cross section which includes an inner flange 276, a web 278 extending perpendicularly outwardly from the middle of inner flange 276 about ⅝ inch to 30° downward bend 280, then extends downwardly and outwardly to an upwardly extending outer flange 282. Bend 280 thus divides web 278 into an inner flat portion 284, and an outer diagonal portion 286.

Horizontal stud 272 also includes, at spaced apart locations along web 278, a plurality of upwardly extending tabs 288 and a plurality of downwardly extending tabs 290, each formed of, respectively, 1-inch by 3-inch sections and ½-inch by 3-inch sections of metal cut and bent out of outer diagonal portion 286. Tabs 288 are adjoined to outer diagonal portion 286 adjacent to bend 280, and include an upwardly and outwardly extending angled portion 292 and an upwardly extending portion 294 terminating in an upwardly and outwardly angled lip 296, for ease of insertion of a core board 274. Tabs 290 are adjoined to outer diagonal portion 286 about ½ inch outwardly from bend 280, and include a downwardly extending portion 298 and a downwardly and outwardly extending lip 300.

Inner flange 276 includes an upper double-thickness portion 302 and a lower single-thickness portion 304 which includes a lower hem 306 and a midway rib 308, both extending outwardly from the other parts of lower portion 304.

Horizontal stud 272 is mounted atop an upper edge portion 310 of one of the two core boards 274 in FIG. 11, and a lower edge portion 312 of the other core board 274 is disposed atop stud 272.

The upper edge portion 310 of the one core board 274 is held firmly between tabs 290 and the hem 306 and rib 308 of single-thickness portion 304 of inner flange 276. Upper edge portion 310 has a flat top portion 314 and a bevelled portion 316. Flat portion 314 abuts inner flat portion 284 of web 278 and bevelled portion 316 is parallel to and closely spaced from outer diagonal portion 286 of web 278.

The lower edge portion 312 of the other core board 274 has a flat bottom portion 318, similar to flat top portion 314, and a bevelled portion 320, similar to bevelled portion 316. Flat bottom portion 318 is parallel to and closely spaced from inner flat portion 284 of web 278 and bevelled portion 320 rests on angled portion 292 of tabs 288.

The core boards 274 are relatively easily inserted between the tabs 288 and 290 and the inner flange 276 because of the bevelled portions 316 and 320, which engage and slide on the respective tab lips 296 and 300. Gypsum wide wallboard (not shown) is screw attached against the outer surfaces 322 of outer flanges 282 and to posts 40, 134 and 144.

Figure 12:
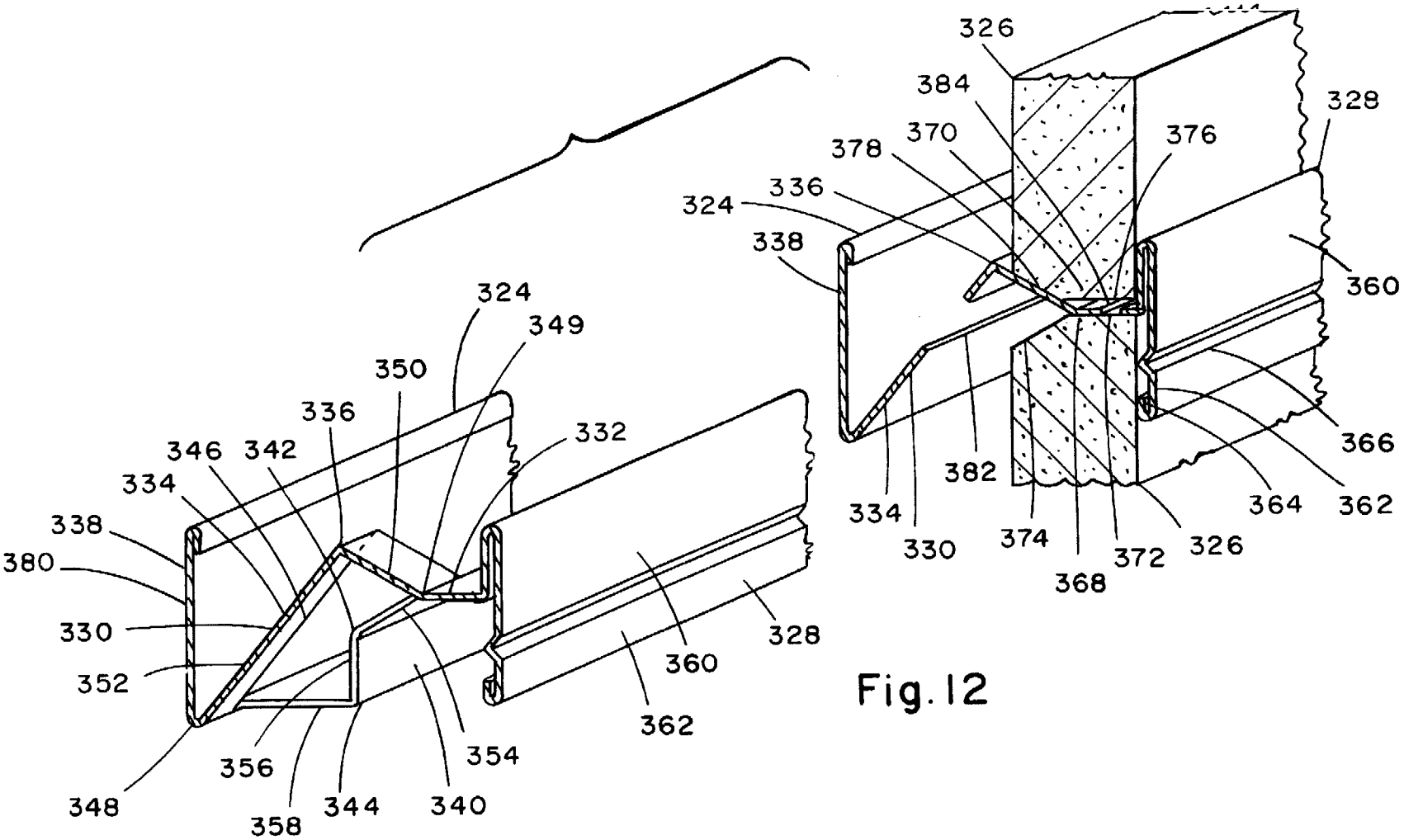

In a preferred embodiment, FIG. 12 shows horizontal studs 324 with two core boards 326, similar to core boards 52. Horizontal studs 324 and core boards 326 are assembled into corner posts 40, intermediate posts 144 and door frame channels 134 in a manner similar to the structures of FIGS.

1, 2 and 6. Horizontal stud 324 is an elongate roll-formed sheet of metal with a cross section which includes an inner flange 328, a web 330 extending perpendicularly outwardly from the middle of inner flange 328 about ⅝ inch, forming a flat portion 332, whereat a major portion 334 of web 330 extends upwardly and outwardly about ⅝ inch to bend 336 and thence downwardly and outwardly to an upwardly extending outer flange 338. A minor portion 340 of web 330, about a 3-inch length of each foot of web, extends downwardly and outwardly about ⅝ inch to bend 342, thence downwardly to bend 344 and thence outwardly to upwardly extending outer flange 338. Slits 346 were cut crosswise of web 330, during forming of horizontal stud 324, from the flat portion 332 to the outer flange 338. The slits 346 are preferably angled slightly to form minor portions 340 which have a shorter dimension along the outer flange bend 348 than along the bend 349, whereat the minor portion 340 is adjoined to the flat portion 332. By angling the slits 346, heat transfer through the stud, from one flange to the opposite flange is reduced, and, also, the studs are more easily stacked for warehousing and shipping.

The bend 336 divides the major portion 334 of web 330 into a ramp portion 350 and a connecting portion 352. The bends 342 and 344 divide the minor portion 340 into a bevel portion 354, a board holding portion 356 and a connecting portion 358.

Both ends of web major portion 334 and of web minor portion 340 are integrally connected to the stud; they have no free or dangling ends. Thus, as shown in FIG. 12, web 330 has no tabs or any other part with a dangling or free end, all of which enhances the structural integrity of the web.

Inner flange 328 includes an upper double-thickness portion 360 and a lower single-thickness portion 362 which includes a lower hem 364 and a midway rib 366, both extending outwardly.

Horizontal stud 324 is mounted atop an upper edge portion 368 of one of the two core boards 326 in FIG. 12, and a lower edge portion 370 of the other core board 326 is disposed atop stud 324.

The upper edge portion 368 of the one core board 326 is held firmly between board holding portion 356 of web minor portion 340 and the hem 364 and rib 366 of single-thickness portion 362 of inner flange 328. Upper edge portion 368 has a flat top portion 372 and a bevelled portion 374 with an elongate corner therebetween of about 150°. Flat portion 372 abuts flat portion 332 of web 330. Bevelled portion 374 is parallel to and closely spaced from minor portion, bevel portion 354.

The lower edge portion 370 of the other core board 326 has a flat bottom portion 376, similar to flat top portion 372, and a bevelled portion 378 similar to bevelled portion 374. Flat bottom portion 376 is parallel to and closely spaced from flat portion 332 of web 330, and the junction of flat bottom portion 376 and bevelled portion 378 rests on ramp portion 350.

The core boards 326 are inserted onto each previously mounted horizontal stud 324 by merely sliding the bevelled portion 378 of lower edge portion 370 down the ramp portion 350 of the web 330 until the lower edge portion 370 abuts the double-thick portion 360 of inner flange 328. The lower edge portion 370 is held between the ramp portion 350 and inner flange 328 by the weight of the core board 326, plus the weight of all core boards 326 and horizontal studs 324 which are thereabove a part of the wall.

The horizontal studs 324 are forced onto the upper edge 368 of each core board 326, with the core board bevelled portion 374 guiding the stud web minor portion 340 into the space between the inner flange 328 and the board holding portion 356.

Gypsum wide wallboard (not shown) is screw attached against the outer surfaces 380 of the outer flanges 338 and to posts 40, 134 and 144.

In the preferred forms of the invention, narrow, elongate slots 382 are arranged at spaced locations along the webs 80, 106, 176, 226, 278 and 330, typically about 3 inches by ½ inch, spaced an inch apart, for reducing the heat conductivity through a wall, in case of fire on one or the other sides of the wall. Also, horizontal studs 54, 170, 220, 272 and 324 could have 3/16-inch by 2¼-inch vent holes 384 added, with ¾-inch spacing, similar to the vent holes 104 in stud 100.

With regard to the application of two layers of gypsum wide wallboard 56, 58, on any of the horizontal stud embodiments, these ½-inch or ⅝-inch wallboards may be screw applied with their long dimension horizontal or vertical or with one layer horizontal and one layer vertical. All-vertical application is normally preferred, with joint locations staggered. With regard to the installation of all-horizontal studs 54, 170 and 220 in side wall 10 with tabs 86, 190 and 236 extending downward, although this is the preferred construction, the walls could be constructed with tabs 86, 190 and 236 extending upward; that is, by reversing the horizontal studs 54, 170 and 220 and reversing the core boards 52 and 222.

Figure 7:
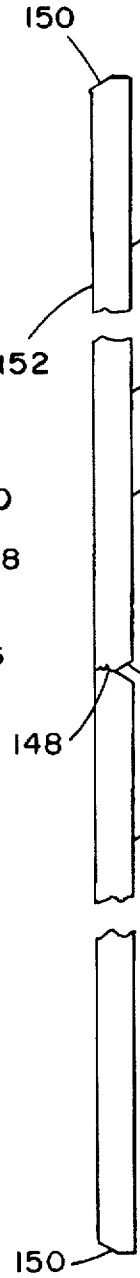
FIG. 7 is an end view of a double-width board for forming two core boards.
Figure 8:
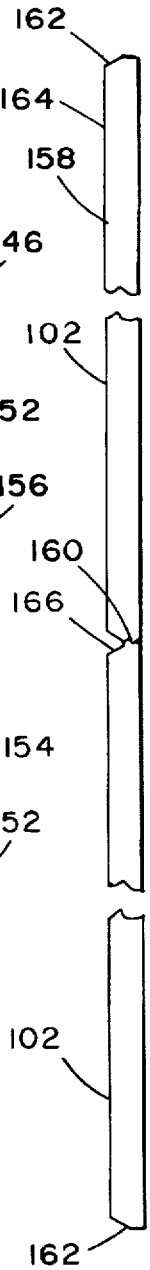
FIG. 8 is an end view of a double-width board for forming two modified core boards.

FIGS. 7 and 8 show how two 2-foot-wide core boards 52 and 222 or 102 can be manufactured as a substitute for the more common standard 2-foot-wide core board. In FIG. 7, a 4-foot-wide, 1-inch-thick, paper-covered gypsum board 146 is shown with a jagged break line 148 in the center of board 146. By forming board 146 with two bevelled edges 150 adjacent the top face 152 and a V-groove 154 in the center of the back face 156, the wide board 146 can be broken in half to form two core boards 52 or 222.

In FIG. 8, a 4-foot-wide, 1-inch-thick, paper-covered gypsum board 158 is shown with a jagged break line 160 in the center of board 158. By forming board 158 with two bevelled edges 162 adjacent the top face 164 and V-groove 166 in the center of the top face 164, the wide core board 158 can be broken in half to form two core boards 102. The present invention has an added advantage in that the rough, jagged edges formed by breaking wide gypsum boards 146, 158, extend into a 60° channel in either of the horizontal studs 5, 100 or 220 where the jagged edges present no problem.

FIGS. 13 to 15 illustrate a preferred construction of the intermediate vertical post 401, which is an alternative to the post 144 shown in FIG. 6. With reference first to FIG. 14, the post 401 comprises three roll-formed sheet metal parts 402, 403 and 404. The parts 402 and 404 are J-shaped structures including webs 402A and 404A, long flanges 402B and 404B, and short flanges 402C and 404C, respectively. The part 403 is hat shaped and includes a web 406, two long flanges 408 and 409, and two short flanges 410 and 411. The flanges 408 and 409 are spaced apart and parallel, and they are perpendicular to the web 406 and to the short flanges 410 and 411. The three parts 402, 403 and 404 are firmly secured together, as by spot welding, with the webs 402A and 404A against the outer sides of the flanges 408 and 409, and with the flanges 402C and 404C against the outer sides of the flanges 410 and 411. FIG. 13 shows the assembled parts 402, 403 and 404. The flanges 402C, 404C, 410 and 411 have essentially the same length.

The long flanges 408 and 409 are substantially longer (in this example, about twice as long) as the webs 402A and 404A. The width of the space 412 between the two flanges 408 and 409 is determined by the length of the web 406 and it is sized to receive a double thickness of the core boards. Two strips 413 (FIGS. 13 and 15) of core board are snugly inserted into the space 412 as shown in FIG. 13.

With reference to FIG. 13, a relatively long wall 415 requires a vertical center post between the corner posts as illustrated by the post 144 in FIG. 6, the center post serving to support the adjacent ends of the horizontal studs and the horizontally elongated core boards. Long core boards 416 and 417 are positioned against the interior surfaces of the flanges 402B and 404B and short lengths of core boards 418 and 419 are positioned against the outer sides of the boards 416 and 417 within the openings of the J-channels 402 and 404. Fasteners 421 secure the boards 416–419 to the long flanges 402B and 404B. Thereafter, one or more layers of boards 422 are positioned against the flanges 410 and 411 and secured thereto by fasteners 423.

The vertical center post 401 is highly advantageous because it forms a sturdy support in the center area of the wall and it is relatively fire-resistant. The relatively wide flanges 408 and 409 plus the J-channels 402 and 404 form a relatively rigid support, particularly when secured to the boards 416–419 and 422. The strips 413, 418 and 419 of core board enhance the fire-resistant structure.

Figure 16:
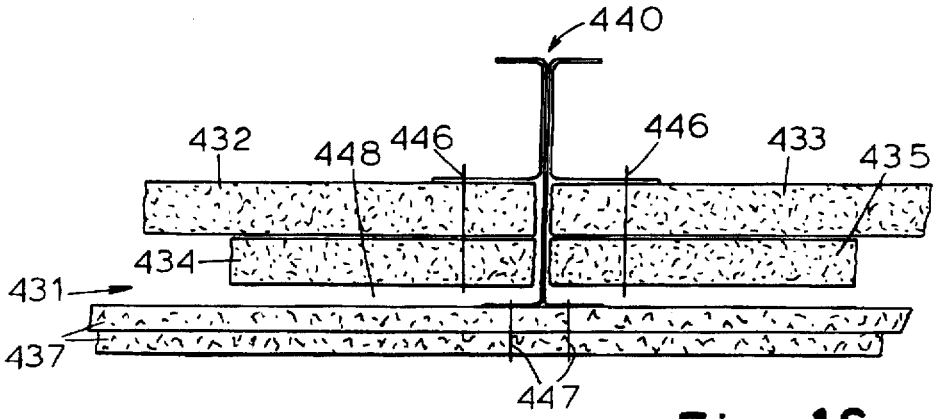
FIGS. 16 and 17 are views similar to FIGS. 13 and 14 but showing an alternative construction.
Figure 17:
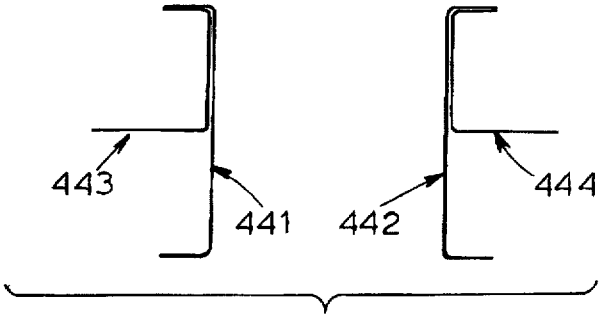

FIGS. 16 and 17 illustrate an alternative construction of a vertical center post for a wall 431. The wall 431 includes core boards 432 to 435 corresponding to core boards 416 to 419, and it includes boards 437 corresponding to boards 422. The center post 440 is formed by two C-channels 441 and 442 and by two J-channels 443 and 444. The webs and the short flanges of the channels 443 and 444 are secured to the webs and inner flanges of the channels 441 and 442 with the flanges extending parallel to each other, and the webs of the channels 441 and 442 are secured together in back-to-back relation.

In the assembled wall 431, the core boards 432 to 435 are mounted between the J-channels 443 and 444 and the outer flanges of the C-channels 441 and 442, and the boards are secured by fasteners 446. The boards 437 are secured by fasteners 447 to the outside surfaces of the outer flanges of the C-channels 441 and 442.

It will be apparent from FIG. 16 that the webs of the C-channels 441 and 442 are extra long and project from the boards 432 and 433, and they hold the boards 437 separated from the boards 432 to 435, thereby forming an air space 448 (such an air space is also formed by the other center posts described herein).

Figure 19:
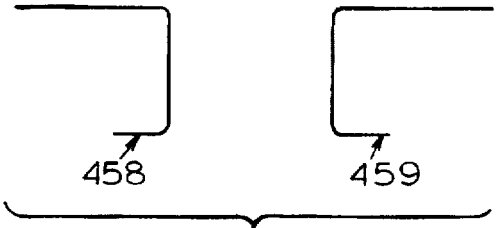
FIGS. 18 and 19 are views similar to FIGS. 13 and 14 but showing another alternative construction.
Figure 18:
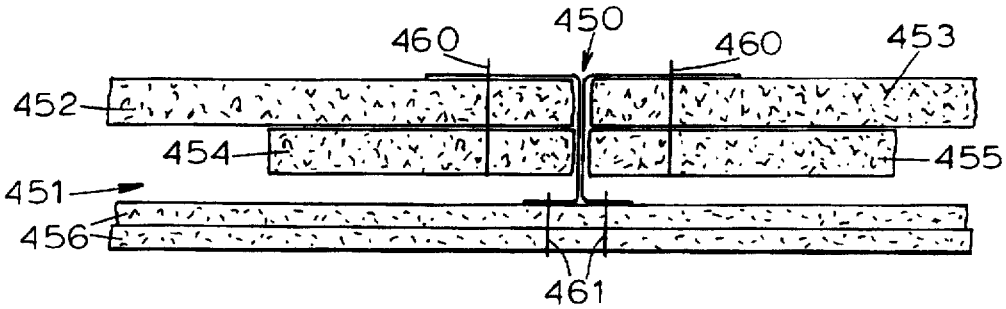

FIGS. 18 and 19 show another vertical center post 450 in a wall 451 which again includes core boards 452 to 455 and gypsum boards 456. The post 450 is formed by two J-channels 458 and 459 which have their webs positioned in back-to-back relation and secured together. The boards 452 to 455 are positioned within the openings of the J-channels and are secured by fasteners 460 to the interior sides of the longer flanges. The boards 456 are spaced from the boards 452 to 455 and are secured by fasteners 461 to the exterior sides of the shorter flanges. To increase the strength of the post 450, the flanges of the J-channels 458 and 459 may be made longer and/or thicker than is customary.

FIG. 20 illustrates an improved vertical corner post 470 at the juncture of two walls 471 and 472. The wall 471 includes a core board 473 and a double thickness of two gypsum boards 474 and 475. Similarly, the wall 472 includes a core board 476 and two boards 477 and 478. It will be apparent from a comparison of FIGS. 2 and 20 that the walls are generally similar. While not shown in FIG. 20 (but shown in FIG. 2) the two walls 471 and 472 also include horizontal studs, a lower floor track and an upper ceiling track, as disclosed herein.

While FIG. 20 shows the parts slightly spaced from each other, this is done merely to better illustrate the construction. Normally the parts are mounted close together. Where the ends of the boards 474–475 meet the ends of the boards 477–478, the cut ends are staggered as indicated at 479 to improve the seal at the corner.

The post 470 is a single piece roll-formed sheet metal member. It includes a web 481, a short flange 482 and a long flange 483 connected in the shape of a J-track; and a short flange 484 and a long flange 485 connected in the shape of an L-track. The ends of the flanges 482 and 485 are integrally formed, and the flange 482 closely overlies a portion of the flange 485. The board 476 is secured by a fastener 487 to the interior surface of the flange 483, the board 473 is secured by a fastener 488 to the exterior surface of the web 481, the boards 474 and 475 are secured by a fastener 489 to the exterior surface of the flange 484, and the boards 477 and 478 are secured by a fastener 490 to the exterior surface of the flange 485.

A comparison of FIGS. 2 and 20 will reveal that the post 470 is the same as the post 40 except that the flange 483 is substantially longer than the corresponding flange of the post 40. The longer length of the flange 483 enables the fastener 487 to be installed from the outside of the wall before the boards 477 and 478 are installed because the fastener 487 is located to the left (as seen in FIG. 20) of the flange 482. Further, the fastener is able to penetrate the board 476 at a location substantially spaced from the edge 491, so that the edge portion of the board 476 does not fracture. The longer length of the flange also increases the strength of the post 470.

Another very important advantage of the present invention is in the fact that the construction of a wall in accordance with the invention, such as side wall 10, involves constructing, essentially, a two-foot wall with the lowest core board 52, then a four-foot wall with the second lowest core board 52, etc. Construction of these walls can be stopped at any two-foot multiple height. Accordingly, a desired four-foot wall can be erected with no extra trouble for use as a temporary safety wall around an elevator shaft prior to the time when a complete elevator shaft wall is desired, leaving access to the shaft, over the four-foot wall, during early phases of construction, for easy installation of cants or the like. Also, accordingly, core boards can be omitted or removed from between the top horizontal stud and the ceiling track without weakening substantially the resultant wall, as occurs in prior vertical stud structures, wherein portions of vertical studs must be cut away. This omission is sometimes necessary to install elevator rail supports/brackets.

Of greatest significance, is the fact that with horizontal studs carrying the weight of core boards, the horizontal studs are effectively made stronger proportional to the weight on them, which is not true of vertical studs, which obviously do not carry the weight of core boards between them. With core board edges bevelled and horizontal stud webs or tabs at corresponding acute angles, a substantial increase in strength and stiffness is provided in the resultant wall. As a result, horizontal studs which are only about 2½ inches, flange-to-flange, are adequate regardless of the height of the wall.

It should also be noted that the construction of walls in accordance with the invention is easier and faster than prior shaft walls, and is suitable for construction from one side, the side opposite the shaft. Contributing most to the ease of erection is the use of the horizontal stud with a wide, angled-bottom channel into which the bottom edge of each core board is fed. More particularly, the web of the stud includes structure for guiding the bottom edge of the core board laterally toward the stud's inner flange, under the urging of gravity. For example, in the embodiment of FIG. 9, the guide structure comprises web diagonal portion 186; in FIG. 10, it comprises web diagonal portion 232; in FIG. 11, it comprises upwardly and outwardly extending lip portion 296 and angled portion 292; and in FIG. 12, the guide structure comprises web ramp portion 350. This type of guide structure facilitates positioning of the core board at the desired location on the stud by an assembler whose vision of that location can be impeded by the core board during assembly. In all such embodiments the guiding function results from the presence of web structure which is engageable with the lower edge of the core board and which is inclined downwardly and inwardly toward the inner flange of the stud which, in the preferred embodiments, includes an upper portion having a double thickness of sheet metal. That part of the core board adjacent its lower edge is positioned adjacent the double thickness of sheet metal on the inner flange, and that feature functions to retain the core board in place, during a fire, for a relatively long period of time compared to an inner flange having a single thickness of sheet metal at that location.

Still additional advantages of the invention reside in the strong vertical corner posts and vertical center post, which support the core boards and the horizontal studs. The center post further enables a very long wall to be assembled.

Although the invention has been described as a shaft wall for construction around elevator shafts, its advantages will be equally available when the wall is constructed anywhere else, such as around stairwells or as area separation walls of the type commonly constructed between adjoining condominiums and townhouses. It is presently contemplated that the walls of the present invention can be successfully constructed with heights of up to about 36 feet, compared to about 12 feet for a similar sized vertical stud of prior shaft walls. If core boards can be made with greater resistance to crushing than presently normal, there would be no reasonable height limitation. Conversely, prior shaft walls required vertical studs with dimensions of more than 2½ inches flange-to-flange when the wall exceeded the normal heights. For example, 4-inch and 6-inch flange-to-flange vertical studs were required for constructions when heights increased above about 14 feet. The present invention provides a system wherein the 2½-inch flange-to-flange dimension is adequate regardless of wall height. Still further, the horizontal stud of the present invention requires the same or less metal than any prior shaft wall stud.

It will be appreciated that a solid wall configuration built in accordance with the present invention will also provide a number of benefits of the preferred embodiments of the invention.

Having completed a detailed description of the preferred embodiments of my invention so that those skilled in the art may practice the same, I contemplate that variations may be made without departing from the essence of the invention.

I claim:

1. A hollow wall, extending vertically upwardly from a floor, readily assembleable from a first outer side and suitable for construction where a second inner side is relatively inaccessible, comprising:

(a) means, at each end of said hollow wall, for receiving and grasping ends of horizontally extending studs and maintaining the position of said studs, providing a substantially vertically aligned end of said hollow wall;

(b) at least one horizontally disposed, elongate, metal stud, said stud having an inner flange, a central web and an outer flange, said web extending between and connecting said inner and outer flanges;

(c) at least first and second gypsum boards, each of said boards having an upper edge and a lower edge, said lower edge of said first gypsum board being immediately above said stud and supported on said central web of said stud, said upper edge of said second gypsum board being immediately below said stud and disposed against and supporting said central web of said stud substantially below said lower edge of said first gypsum board, said gypsum board edges being spaced inwardly from said outer flange of said stud and being substantially adjacent said inner flange;

said stud having opposed ends grasped by said receiving and grasping means, and said stud maintaining said gypsum boards in vertically aligned position; and (d) additional gypsum board affixed to an outer face of said outer flange of said stud.

2. A hollow wall as defined in claim 1, wherein said web of said stud includes an acutely angled portion closely adjacent said inner flange, said portion extending outwardly and upwardly at an acute angle to said inner flange, said lower edge of said first gypsum board being supported at least in part on said outwardly and upwardly angled portion of said web of said stud, and said upper edge of said second gypsum board being immediately below said stud and supporting said web.

3. A hollow wall as defined in claim 1, wherein said web includes an acutely angled portion, and said stud has an upwardly opening channel formed between said acutely angled portion of said web and said inner flange whereby, during construction of said wall, said first and second gypsum boards can be very easily and quickly placed on said acutely angled portion and slid down to a lowest possible position against said inner flange whereby said boards become quickly laterally affixed in a stable position.

4. A hollow wall as defined in claim 2, and further including means on said stud for holding said gypsum board edges adjacent said inner flange, said means on said stud comprising said acutely angled portion of said web as to said lower edge of said first gypsum board and a plurality of short tabs cut and bent downward out of said web as to said upper edge of said second gypsum board.

5. A hollow wall as defined in claim 2, wherein said web includes a mid-wall portion parallel to said inner flange and said means on said stud comprises said acutely angled portion of said web as to one edge of one of said gypsum boards and said mid-wall portion as to one edge of a second of said gypsum boards.

6. A hollow wall as defined in claim 2, wherein said stud further comprises a plurality of short tabs, some of said tabs being cut and bent downwardly out of said web and the others of said tabs being cut and bent upwardly out of said web.

7. A hollow wall as defined in claim 2, wherein said stud further comprises alternating portions of said web, said web having a plurality of spaced laterally extending slits separating said alternating portions, said alternating portions including upwardly bent web portions and downwardly bent portions, said acutely angled portion of said web being a part of said upwardly bent web portion, said downwardly bent portions including means for holding said upper edge of said second gypsum board spaced from said outer flange.

8. A hollow wall as defined in claim 1, wherein said wall is divided into a plurality of sections, said sections being defined by an intermediate vertical post separating said sections, said intermediate vertical post extending upwardly from said floor and having a pair of oppositely directed, vertically extending channels, said horizontal stud and said core boards having ends extending into said channels of said intermediate vertical post.

9. A hollow wall as defined in claim 1, wherein said means for receiving and grasping ends of horizontally extending studs comprises two fixed vertical posts, each of said vertical posts extending upwardly from said floor at an end of said hollow wall, and each of said vertical posts having a vertically extending channel with a channel opening directed toward the other of said vertical posts, and wherein said stud and said gypsum boards have opposed ends extending into said channels of said pair of vertical posts.

10. A hollow wall as defined in claim 9, further comprising an upwardly opening channel-like floor track affixed to said floor and having a vertical inner flange and a vertical outer flange, a downwardly opening channel-like ceiling track affixed to a ceiling and having a vertical inner flange and a vertical outer flange, said vertical posts having bottom ends affixed within said floor track and top ends affixed within said ceiling track, a lowermost of said gypsum boards having a lower side edge affixed to an inner side of said floor track inner vertical flange, an uppermost of said gypsum boards having an upper side edge affixed to an inner side of said ceiling track inner vertical flange, and said additional gypsum board having bottom and top edges affixed to an outer side of said floor and ceiling tracks' outer vertical flanges.

11. A hollow wall as defined in claim 10, wherein said horizontal stud webs and said ceiling track have a plurality of vent holes, permitting increased air circulation during a fire and increasing the fire-resistance rating of said wall.

12. A hollow wall as defined in claim 9, wherein said horizontal stud web includes a portion closely adjacent said inner flange and extending outwardly and upwardly at an acute angle to said inner flange, said lower edge of said first gypsum board being supported at least in part on said outwardly and upwardly angled portion of said web of said stud and said upper edge of said second gypsum board immediately below said stud supporting said web.

13. A hollow wall as defined in claim 12, wherein said horizontal stud has an upwardly opening channel formed by said acutely angled portion of said web and said inner flange whereby, during construction of said wall, said first gypsum board can be very easily and quickly placed on said acutely angled portion and slid down to a lowest possible position against said inner flange whereby it becomes quickly laterally affixed in a stable position.

14. An enclosure formed by four hollow walls, said four walls each extending vertically upwardly from a floor, readily assembleable from a first outer side and suitable for construction where a second inner side is relatively inaccessible, comprising:

(a) means, at each end of each of said hollow walls, for receiving and grasping ends of horizontally extending studs and maintaining the position of said studs, providing a substantially vertically aligned end of said hollow wall;

(b) at least one horizontally disposed, elongate, metal stud, said stud having an inner flange, a central web and an outer flange, said web extending between and connecting said inner and outer flanges;

(c) at least first and second gypsum boards, each of said boards having an upper edge and a lower edge, said lower edge of said first gypsum board being immediately above said stud and supported on said central web of said stud, said upper edge of said second gypsum board being immediately below said stud and disposed against and supporting said central web of said stud substantially below said lower edge of said first gypsum board, said gypsum board edges being spaced inwardly from said outer flange of said stud and being substantially adjacent said inner flange;

said horizontal stud having opposed ends grasped by said receiving and grasping means, and said stud maintaining said gypsum boards in vertically aligned position; and (d) additional gypsum boards affixed to an outer face of said outer flange of said stud;

said four walls being interconnected by said receiving and grasping means, whereby each said receiving and grasping means functions as said receiving and grasping means for two of said walls.

15. An enclosure as defined in claim 14, wherein said floor has a floor opening, and said four walls are disposed adjacent said floor opening, and said inner flange of each of said studs is disposed on a side of said walls which is adjacent said floor opening.

16. An enclosure as defined in claim 15, wherein said four walls enclose an elevator shaft and at least one of said walls has an elevator doorway therein, said elevator doorway having a pair of opposed vertical doorway channels on each side of said doorway extending upwardly from said floor, said doorway channels having openings directed away from said doorway, said wall having said doorways having said stud and said gypsum boards adjacent said doorway and extending into said doorway channels.

17. An enclosure as defined in claim 14, wherein said each of said two of said interconnected walls form a substantially right angle corner, and said receiving and grasping means comprises first and second channels, said first and second channels forming first and second channel openings which face said interconnected walls, said gypsum boards of said interconnected walls extending into said first and second channel openings and being secured to said first channel, and said additional gypsum boards of said interconnected walls being outside of said channel openings and being secured to said second channel.

18. An enclosure as defined in claim 17, wherein said first and second channels are integrally formed of roll-formed sheet metal.

19. A hollow wall extending upwardly from a floor, said wall having an inner side and an outer side and comprising:

a plurality of horizontally disposed, vertically spaced, elongate, formed sheet metal studs each having a pair of opposite ends;

each stud having an inner flange, an outer flange and a web extending laterally between and joining said flanges;

a plurality of first gypsum boards each having a pair of opposite side ends, an upper edge and a lower edge;

means, at each end of said hollow wall, receiving said ends of said studs and maintaining the position of said studs, providing a vertically aligned end of said hollow wall;

means on each stud engaging one of said first gypsum boards adjacent the upper edge thereof to support the weight of said stud atop said first gypsum board;

means on each stud engaging another of said first gypsum boards adjacent the lower edge thereof to support the weight of said first gypsum board atop said stud, whereby said one of said first gypsum boards supports the weights of said stud and said another of said first gypsum boards;

means on each stud holding each of said first gypsum boards, engaged by said stud, adjacent the inner side of said wall and spaced from the outer side of said wall;

and a plurality of second gypsum boards and means on each stud mounting said second gypsum boards adjacent the outer side of said wall and spaced from said first gypsum boards which are adjacent the inner side of said wall.

20. A hollow wall as defined in claim 19, wherein said means receiving said ends of said studs comprises a pair of vertically disposed, horizontally spaced posts each of said posts having means for receiving an end of each stud and each of said first gypsum boards.

21. A hollow wall, as recited in claim 19, wherein:

all of said studs have a lateral dimension of about 2.5 in.

22. A hollow wall as recited in claim 19, wherein:

all of said studs have a thickness of about 0.020 in.

23. A hollow wall as recited in claim 19, wherein:

said wall has a height between 12 and 16 ft.

24. A hollow wall as recited in claim 22, wherein:

each of said first gypsum boards in said wall has a height of about 2 ft.

25. A hollow wall as recited in claim 21, wherein:

all of said studs have a thickness of about 0.020 in.

26. A hollow wall as recited in claim 21, wherein:

said wall has a height between 12 and 16 ft.

27. A hollow wall extending vertically upwardly from a floor to a ceiling and formed by at least first and second wall sections, said wall sections extending at substantially right angles one to the other and adjoining to form a corner, a vertical corner post at said corner and connecting said first and second wall sections, said corner post comprising first and second channels forming first and second channel openings, each of said wall sections comprising a plurality of horizontally extending core boards, a plurality of wallboards spaced from said core boards, and a plurality of horizontal studs, said core boards being separated by said studs, said core boards and said studs of said first wall section having ends extending into said first channel and said core boards and said studs of said second wall section having ends extending into said second channel, said first and second channels being secured together and said core boards of said first and said second wall sections being secured to said first channel.

28. A hollow wall as defined in claim 27, wherein said wallboards are secured to said horizontal studs, said wallboards being further secured to said second channel.

29. A hollow wall as defined in claim 27, wherein said first and second channels are integrally formed of roll-formed sheet metal.

30. A hollow wall extending vertically upwardly from a floor to a ceiling and formed by at least first and second wall sections, said wall sections being substantially coplanar and having adjacent edges, each of said wall sections comprising a plurality of horizontally extending core boards, a plurality of horizontal studs between said core boards, said studs being spaced apart in the vertical direction, and a plurality of wallboards secured to said studs, each of said wallboards extending adjacent at least three of said studs and being secured thereto, and a vertical center post between and attached to said adjacent edges, said center post comprising two channels positioned in back-to-back relation, each of said channels forming a channel opening which receives said core boards and said horizontal studs of one of said wall sections, means securing said channels together, means securing said core boards to said channels, and means securing said wallboards to said channels on the outside of said channel openings.

31. A hollow wall extending upwardly from a floor, said wall having an inner side and an outer side and comprising:

a plurality of horizontally disposed, vertically spaced, elongate, formed sheet metal studs each having a pair of opposite ends;

each stud having an inner flange, an outer flange and a web extending laterally between and joining said flanges;

a plurality of first gypsum boards each having a pair of opposite side ends, an upper edge and a lower edge, each of said first gypsum boards being elongated in the horizontal direction;

means, at each end of said hollow wall, receiving said studs and maintaining the positions of said studs substantially in vertical alignment, thereby providing a vertically aligned end of said hollow wall;

said web of each stud engaging one of said first gypsum boards adjacent said upper edge thereof to support the weight of said stud atop said first gypsum board;

said web of each stud engaging another of said first gypsum boards adjacent the lower edge thereof to support the weight of said first gypsum board atop said stud;

said second gypsum boards being elongated in the vertical direction and being positioned adjacent the outer side of said wall and spaced from said first gypsum boards which are adjacent the inner side of said wall, each of said second gypsum boards extending vertically adjacent three or more of said studs on the outside of said outer flanges and being secured to said outer flanges.

* * * * *